United States Patent [19]

Crump

[11] 4,311,333

[45] Jan. 19, 1982

[54] EQUIPMENT CARRYING AND, OR, SECURING DEVICE

[76] Inventor: John M. Crump, 1018 Parkridge Cir. W., Jacksonville, Fla. 32211

[21] Appl. No.: 128,673

[22] Filed: Mar. 10, 1980

[51] Int. Cl.[3] ..... A45F 5/10

[52] U.S. Cl. ..... 294/147; 294/163; 294/165

[58] Field of Search ..... 224/45 S, 45 Q, 46 R, 224/50, 917; 211/37; 280/814, 815; 294/147, 163, 165

[56] References Cited

U.S. PATENT DOCUMENTS

| | | | |
|---|---|---|---|
| 2,956,813 | 10/1960 | Madden | 224/45 S |
| 3,210,787 | 10/1965 | Allsop | 12/120.5 |
| 3,248,027 | 4/1966 | Pfleider | 224/45 S |
| 3,260,430 | 7/1966 | Sandenburgh | 224/45 S |
| 3,272,413 | 9/1966 | Pfleider | 224/45 S |
| 3,718,242 | 2/1973 | Larson | 224/45 S |
| 3,990,655 | 11/1976 | Covell | 224/45 S |
| 4,190,182 | 2/1980 | Hickey | 224/45 S |

*Primary Examiner*—Steven M. Pollard

[57] ABSTRACT

The invention is a device for carrying and, or, securing any desired combination of equipment such as skis, poles and boots. The device includes oppositely disposed equipment retainer means symmetrically related and movably mounted in a mutually aligned relationship relative to a base member. Said retainer means being selectively adjustable to allow any desired combination of said equipment, or the like, to be retained therewith. Manipulatable securing means is provided such that the said retainer means may be adjusted to accommodate various equipment sizes and also to provide a method whereby the consequential assembling of any combination of said equipment causes said equipment to be releasably secured therewith and further providing means incorporated into the same device for locking said device with a cable type security lock, or the like.

11 Claims, 10 Drawing Figures

EQUIPMENT CARRYING AND, OR, SECURING DEVICE

TECHNICAL FIELD

The present invention relates to a device for carrying and/or securing any combination of equipment such as skis, poles and boots, or the like, while simultaneously providing a method of assembling such equipment in a single, integral means for securing the complete device and any combination of equipment retained therewith when a skier leaves the equipment unattended in a ski resort, public area, or any place where convenience and security are desired for such equipment.

BACKGROUND ART

The prior art, U.S. Pat. No. 3,210,787, provides for boot carrying only. U.S. Pat. No. 3,990,655 provides for ski and pole carrying and securing. Each of these devices is limited to their independent uses.

This applicant has disclosed another embodiment of the present invention in application Ser. No. 06/057,306 dated July 13, 1979.

DISCLOSURE OF INVENTION

In accordance with the present invention, I provide a method of assembling skis, poles and boots, or the like, into a single, integral device having cooperable members for carrying and/or securing any desired combination of equipment such as skis, boots and poles. The device includes a pair of mutually aligned cooperable retainers, each selectively movable on a centrally located column member, one of the retainers being adapted to cooperate with a base portion to form a pair of ski and pole magazine retention chambers. The device consisting of a unitary mechanism having relatively symmetrically configured movable parts that may be selectively adjusted to variable positions to receive boots, skis and poles into releasable securement therewith and which may be locked in their enclosed or retaining positions.

My improved carrying and securing device provides a novel method of assembling and the advantage that the cooperable parts are adjustable and selectively manipulatable thereby allowing the device to not only be utilized to accomodate the full range of equipment sizes but to also be retracted to a minimum height when the device is utilized for carrying and/or securing skis and poles without boots.

The single adjustable securing and locking means is common to all adjustment and utilization features inherent in this invention such that the device is positively secured in a selected equipment retention position. This feature is of particular advantage since it provides in one single device the capability and methods of carrying and/or securing any desired combination of skis, poles and boots. Other objects and advantages reside in certain novel features of the method of assembly, arrangement and combination of parts which will be hereinafter more fully described and particularly pointed out in the appended claims, reference being made to the accompanying drawings forming a part of this specification.

BRIEF DESCRIPTION OF DRAWINGS

The details, features and principles of my invention will be described with reference to the accompanying drawings, which disclose, by way of example, the principle of the invention and preferred mode contemplated of applying that principle, in which.

BEST MODE FOR CARRYING OUT THE INVENTION

Figure 1:
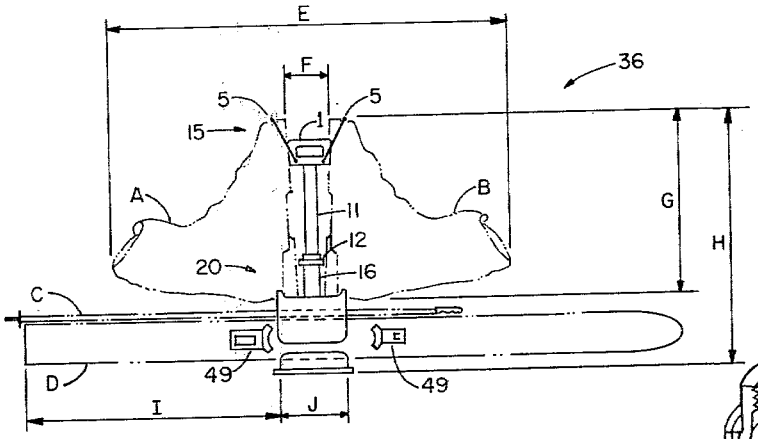
FIG. 1 is a view in side elevation illustrating a method of assembling equipment embodying the present invention.

The preferred embodiments of the present invention may be best illustrated by reference to FIG. 1 wherein a method of assembling equipment in a device 36 is shown for carrying and/or securing any combination of equipment such as skis D, poles C and boots A and B. While the device 36 may be constructed from any suitable material, including wood, the preferred material, bases upon present technological and economic conditions, generally is plastic. Therefore, the shaping and synthesizing of parts has been influenced by the contemplated selection of construction materials while at the same time not compromising the novel features of the invention. Illustrative of the embodiment disclosed, the method of assembly generally designated 36 in FIG. 1 comprises cooperable parts according to the present invention designated 37 in FIG. 2 wherein an adjustable retractile mounting column member 11 is releasably secured to mounting column member 16 utilizing a manipulative securing means 12 which in cooperation with oppositely disposed and symmetrically related boot retention units 15 and 20 provides means whereby any combination of equipment such as skis, poles and boots may be assembled into releasable securement therewith. The device may be made up in the form of a hand tool or implement or, if desired may be made to constitute an appurtenance of an equipment transport means or equipment storage means or other related classes of devices associated with equipment of the class considered herein.

Boots A and B may be reversed such that the boot toe is down and the heel is up in which position dimensions E, F, G and H remain substantially unchanged. When device 36 is utilized for skis D and poles C, without boots A and B, upper boot retaining Unit 15 is adjusted downward by means of adjustable mounting column member 11 and adjustable securing means 12 thereby causing dimensions G and H to be minimum values resulting in device designated 38 illustrated in FIG. 3.

Device 36 may be utilized to carry and secure boots A and B without skis D and poles C in which case the device 36 will appear as shown in FIG. 1 with the skis D and poles C removed. Thus, the movable lower boot retainer and ski magazine Unit 20, upper boot retainer Unit 15 and dimensions E, F, G and H remain substantially unchanged as to general illustration shown in FIG. 1. The base J of device 36 is located generally between ski bindings 49 a distance I from the end of skis D which prohibits skis from being removed from device 36 unless releasable removed from retention Unit 20.

Figure 2:
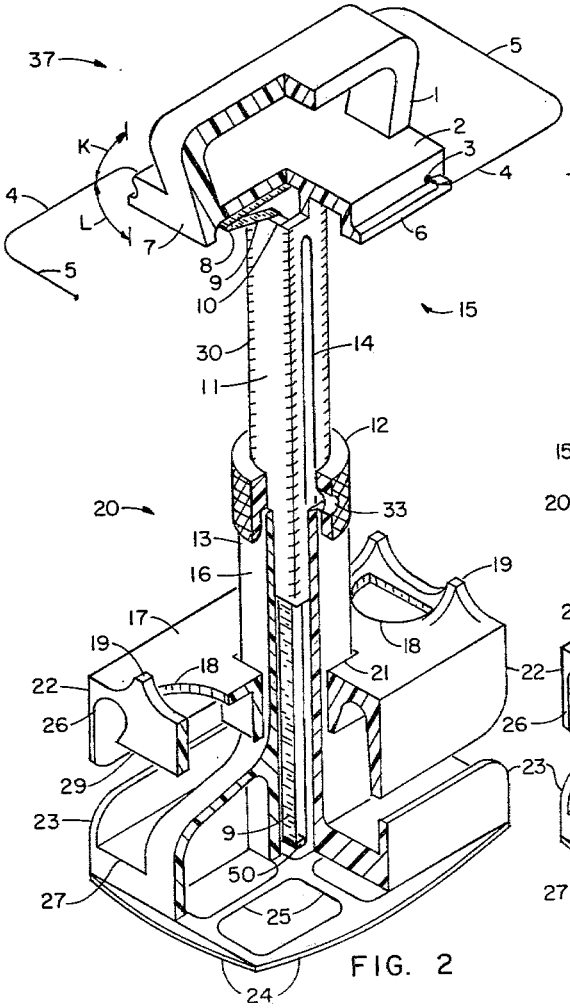
FIG. 2 is a cross-sectional perspective view illustrating the device in extended position as at the beginning of an equipment assembling operation or conclusion of an equipment removal operation.

When the device 36 has the upper boot retainer Unit 15 extended as shown in FIG. 2 the user may install any combination of ski equipment A, B, C or D therewith. The device 37 includes a generally rectangular base member 25 having arcuate flanges 24 formed integral with ski support bases 27, ski retainer side walls 23, and centrally located lower structural mounting column 16 extending upward from base members 25. Concentrically located immediately above ski support bases 27 is a movable lower boot retainer and ski magazine Unit 20. Unit 20 is structured of two oppositely disposed, downwardly depending ski magazine side walls 22 with a top surface structure 17 bridging there between and adapted to form ski and pole retention means 22, 26 and 29. Top member 17 contains a centrally located aperture 21 which allows Unit 20 to be moved up and down guided and restrained against rotation by column member 16. Disposed at opposite ends of structure 17 are congruous lower boot retainers 18 and 19. Parallel with and above ski support bases 27 are pole retention chamber means 26 separated by ski retention means 29. The standardization of boots, for example according to DIN 7880, makes it possible to standardize the congruous lower boot retainers 18 and 19 as well as the upper retainers 5.

Figure 5:
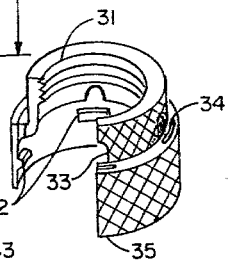
FIG. 5 is an enlarged partial cross-sectional perspective view of adjustable and manipulatable securing means.
Figure 4:
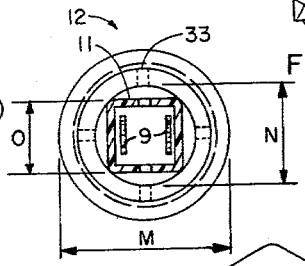
FIG. 4 is a cross-sectional view taken on the line 4—4 of FIG. 6.
Figure 3:
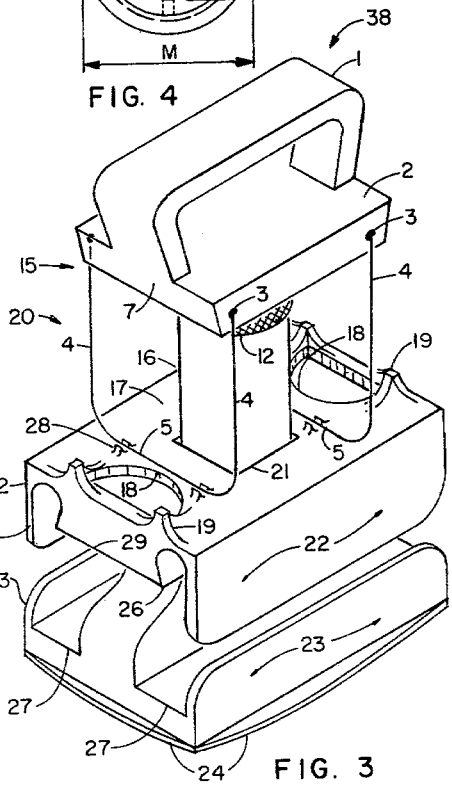
FIG. 3 is a perspective view illustrating the device in the retracted position.

Disposed at the upper terminus of column member 16 is an adjustable securing means 12 of a generally circular configuration, as shown in FIGS. 3, 4 and 5, with a first internal cavity of reduced diameter provided circumferentially with interiorly adjustable engagement means 31 for movable engagement with engagement means 30 on column member 11. A second internal cavity generally larger in diameter than the first cavity is provided with multiple retention means 32 extending interiorly partially around the inner periphery at alternate locations and being disposed for engagement with securing means located generally at the upper exterior surface 13 of column member 16. Thus securing means 12 remains adjustable and removably engaged with column member 11 when disengaged from securement with column member 16. Referring to FIG. 4 means 12 is shown disposed about column member 16 illustrated, for example, as rectangular cross section by dimension N having adjustable column member 11 movably disposed inside with dimension O. The outer circumference of 12 is noted as dimension M. Multiple locking cable apertures 33 are provided through the body of securing means 12 thereby allowing a locking cable (not shown) to be passed through apertures 33 communicating with slot aperture 14 in mounting column 11 thereby providing a positive security lock preventing the movement of securing means 12 until the locking cable (not shown) is removed therefrom. The exterior surface 35 of securing means 12 may be knurled or otherwise provided with projections to facilitate manual manipulation.

Resilient bands or yieldable means 9 are disposed internal to column 11 being connected at the upper extremity to offset portion 8 of boot retainers 5 and at the lower terminus to connector means 50. Resilient means 9 forming one continuous band extending around the offset portion 8 of each upper boot retainer 5 then downward through the inside cavity of column members 11 and 16 and connected to base member 25 by means of connection means 50. Thus, resilient band 9 biases boot retainers 5 to a convenient manipulation position in zone K of FIG. 2 simultaneously with biasing upper boot retainer Unit 15 downwardly causing a compressive force to be exerted upon retaining Unit 20. The structural integrety of device 37 is not dependent upon the resilient band 9 which serve only as an optional accessory to enhance the case of device 37 manipulation during the assembly operations and to effect an urging and biasing of retainer Unit 15 toward retainer Unit 20. Poles C may be releasable secured with device 37 by moving retaining Unit 20 up and placing poles into retention means 26. Skis D may also be releasable secured with device 37 at this time by placing skis D onto ski support bases 27 and allowing retention Unit 20 to move downward thereby causing oppositely disposed ski magazine side walls 22 to continuously urge skis inwardly toward central column member 16 resulting in a clamping and retention action being exerted upon both skis and poles relative to device 37. Observe in FIG. 6 that the interiorly portions of sidewalls 22 may be slightly sloped to produce a camming surface for urging against skis D. Pole retention means 40 allow poles C to be releasably engaged with pole retention chamber means 26. Boots A and B may now be releasably secured with device 37 by placing each boot heel, or toe, into boot retainer means 18 and 19 best shown in FIGS. 2 and 8. Observe in both FIGS. 1 and 2 that each boot, A and B respectively, may now have its sole placed against sole rest surface 7 following which boot retainers 5 may be releasably secured over boot toes depending upon boot position. Securing means 12 may now be adjusted downwardly into contact with top surface of column member 16 and subsequently manipulated to cause interiorly outstanding lip retention means 32, shown in FIG. 5, to be releasably engaged with cooperative means located on upper exterior surface 13 of column member 16. Thus, observe that equipment has now been assembled in device 37 thereby resulting in assembly 36 illustrated in FIG. 1. As shown in FIG. 5 aperture 33 communicating with aperture 14 shown in FIG. 2, provide means whereby a locking cable (not shown) may be inserted for locked securement. It will be observed in FIG. 2 that boot retainers 5 may be rotated down through Zone L and retainer Unit 15 lowered into a retracted position as shown in FIG. 3 whereby skis D and poles C, without boots A and B, may be carried and secured in an assembly illustrated by device 38. It is instructive to teach that in lieu of rotating retainers 5 down as shown in FIG. 3 it is feasible to provide downwardly projecting skirts from either sole rest surface 7 or optional side flanges 6 thereby achieving the same results of locking movable lower boot retainer and ski magazine Unit 20 with securing means 12. Observe, in FIG. 2 that a U shaped member (not shown) coextensive with an oppositely disposed U shaped member (not shown) may be inserted over optional side flanges 6 thereby causing retainer portions 4 to be held detachably captive for pivotal rotation in apertures 3. Furthermore, it is apparent that such an embodiment would provide assembly characteristics conducive to retention of retainers members 5 with retention Unit 15. It is instructive to also teach a related variation associated with retaining Unit 15. Hand carry grasp 1 may be constructed in two parts such that the intersection between the parts occurs generally slightly above offset portions 8 of retainers 5. Thus, by keying the hand grasp 1 to the retainer Unit 15 to allow for horizontal slide in fit up thereby providing an assembly which holds retainers 5 captive and also cannot be dissembled when equipment A and B are retained therewith. When grasp 1 is dissembled from Unit 15 the offset portions 8 and yieldable band 9 are exposed from the top for ease of initial erection.

The preferred embodiment of column members 11 and 16 depends on the details of manufacturing techniques and may be any geometric configuration ranging from circular to rectangular. The square configuration has been shown for simplicity and illustration since it is obvious that these members are susceptible of change and modification without departing from the principles and spirit of the invention.

Figure 6:
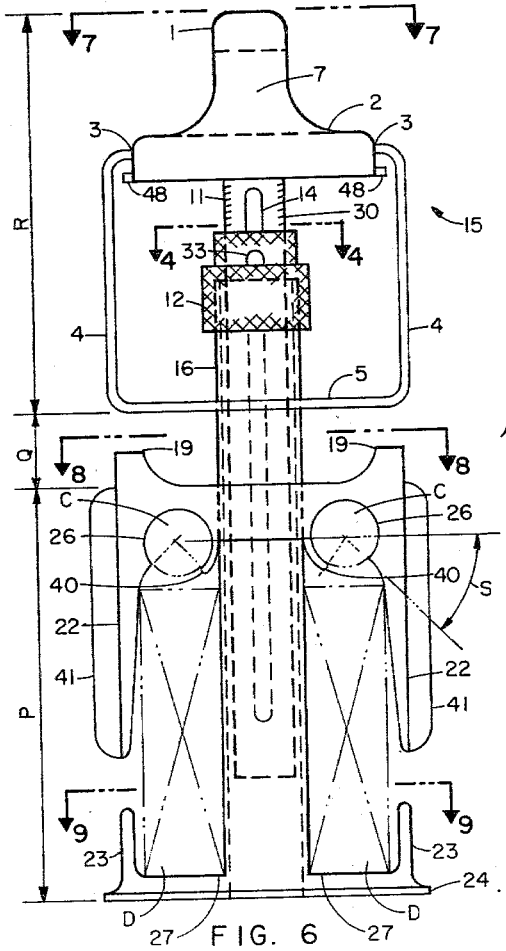
FIG. 6 is an end elevation view.

Turning now to FIG. 6 there is shown an end view of device 38 in retracted position for carrying and securing skis D and poles C. As adjustment means 12 is adjusted upward on column 11 the handle 1 together with retention Unit 15 will move downward causing dimension Q to become zero thereby causing retainers 5 to rest upon top structure 17 of ski and pole magazine unit 39. Adjustment means 12 is now releasable engaged with column member 16 thereby securing skis D and poles C in position. Retainers 5 cannot move because of column 16 and raised portions 19. Retainer holding means 28 may be utilized as shown in FIG. 3. Aperture slot 14 is shown in FIG. 6 for illustration of its interface position with locking aperture 33 the preferred location will be in the adjacent sides of column 16 thereby facilitating the installation of a locking cable (not shown) when boots A and B are retained in device 37. It should be observed, to complete the disclosure, that boot retainer lugs 48 may be utilized to further secure boots A and B against lateral movement. Dimension P varies to suit ski D width while dimension R is relatively fixed and dimension Q normally zero when utilized as device 38 of FIG. 3. Poles C are retained by resilient retention means 40 functioning generally as a snap type clip in conjunction with zone S of pole chambers 26. Ski magazine side walls 22 may be reinforced with ribs 41 to achieve appropiate strength characteristics.

Figure 7:
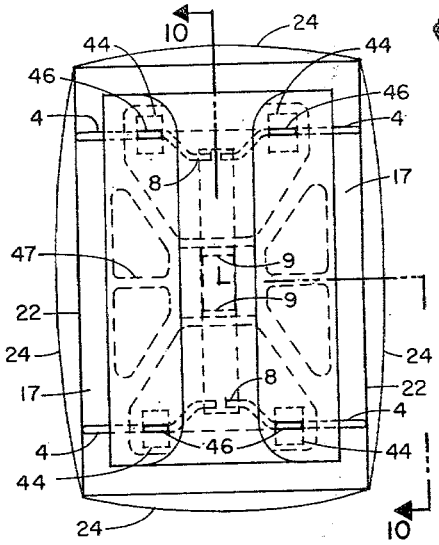
FIG. 7 is a plan view taken on the line 7—7 of FIG. 6.
Figure 10:
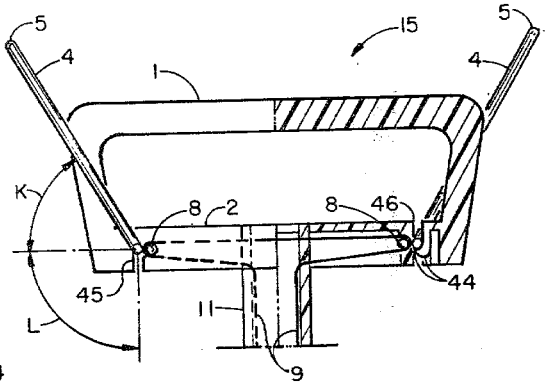
FIG. 10 is a partial cross-sectional side view taken on the line 10—10 of FIG. 7.

FIG. 7 shows more clearly the offset portions 8 of retainers 5 having side portions 4 and resilient band 9 connected therebetween. Apertures 46 provide means for molding snap type retention means 44, best shown in FIG. 10, for holding retainers 5 within slots 45 of upper boot retainer Unit 15. The functioning of retainers 5 in assembly 36 of FIG. 1 is not dependent upon resilient band 9 therefore device 37 of FIG. 2, or device 38 of FIG. 3, continue to function even if resilient band 9 is inoperative or completely removed. However, my full scale working models indicate that resilient band 9 is a useful accessory that facilitates the manipulation of device 37 during assembly, or removal, of equipment. Retainers 5 may be optionally molded as inserts in upper retainer Unit 15. In FIGS. 2 and 10 yieldingly means 9 urges retainers 5 into the posture designated by K simultaneously urging Unit 15 downwardly toward a retracted position with respect to base member 16. Furthermore, while not shown, it is entirely within the principles of device 37 to provide suitable means on member 11 for limiting the retractile movement thereby preventing accidental withdrawal of member 11 from engagement with base member 16.

Figure 8:
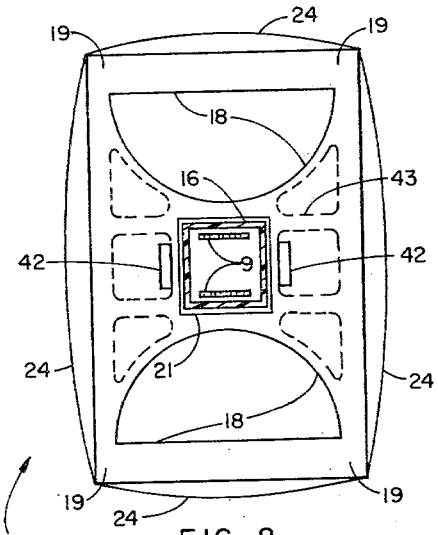
FIG. 8 is a plan view taken on the line 8—8 of FIG. 6.

Referring to FIG. 8 congruous lower boot retainers 18 are shown oppositely disposed and symmetrically about column member 16. Apertures 42 provide means for molding snap type retention means 40, best shown in FIG. 6, for holding poles C. Reinforcing ribs 43 depend upon manufacturing technique and material properties.

Figure 9:
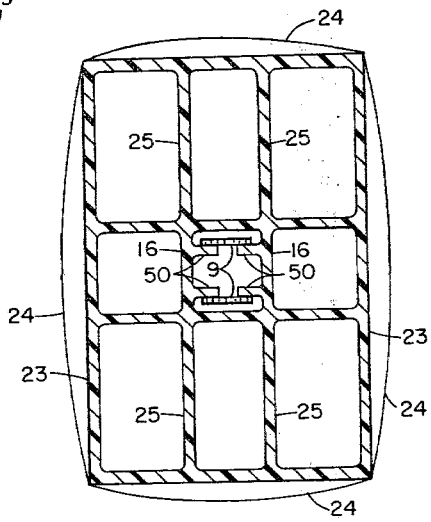
FIG. 9 is a plan view taken on the line 9—9 of FIG. 6.

Base member 25 is best shown in FIG. 9 illustrating relationship of base member structural reinforcing ribs 25, centrally disposed column 16, resilient band 9 and band connecting means 50.

Therefore, the device 37 of FIG. 2 comprises a pair of mutually aligned, selectively manipulatable, and cooperative boot retainer units 15 and 20 each slidable or movably mounted with a structural mounting column 16 such that a pair of oppositely disposed downwardly depending side walls 22 function in cooperation with base member 25 to provide chambers for skis D and pole retention chambers 26. Securing means 12 allows column 11 to be adjusted up and down for selectively engaging any combination of boots A and B, skis D and poles C, into releasable securement therewith.

As shown in FIG. 1 the toes of boots A and B are releasably secured by retainers 5 which are rotatably mounted to upper boot retainer unit 15. When retainers 5 are not engaged with boots A and B they may be positioned in the posture as shown in FIG. 3 further illustrating the synergistic characteristics of the cooperative parts. However, retainers 5 may be positioned at any angle generally designated as angle limits K and L in FIGS. 2 and 10. As previously pointed out, Boots A and B may be reversed and the heels secured by retainers 5.

In order to permit assembling and unloading of equipment with device 36, it has been illustrated that upper boot retainer unit 15 and lower boot retainer and ski magazine unit 20 are movably mounted on lower column 16. FIGS. 2, 3, 4, 5, 6 and 8 respectively show a method of locating column 16 for cooperation with units 15 and 20. Column 16 may be preferably of any geometric shape including circular, rectangular and polygons since each of these shapes will provide at least three surface portions equidistant from a fixed point called the geometric center of column 16 thereby receiving a circumferential securing means 12 of a class as shown in FIGS. 4 and 5. Therefore, FIGS. 4 and 5 disclose a class of securing means 12 that is adaptable to the various cross sectional configurations of members 11 and 16. A significant feature of securing means 12 is its infinite adjustability within the longitudinal limits of member 11 combined with the releasable engagement means to member 16 thereby providing for retention of all sizes of equipment engaged therewith. A securing means, of the class illustrated in FIGS. 4 and 5, provided with threaded connection means 31 to member 11, or other equivalent means for detachably mounting thus allows means 12 to be infinitivally adjusted along the longitudinal axis of member 11 thereby allowing retainer unit 15 to be engaged with all size boots A and B. Furthermore, means 12 also allows retainer unit 20 to be engaged with all sizes of skis D as best illustrated in FIG. 3. As illustrated connection means 31 meshes with member 11 at four corner sectors 30 of rectangular member 11. Observe that only three equidistant sectors are required to make means 12 operational with member 11. The lower portion of means 12 having a radially enlarged cylindrical portion 35 of sufficient axial length below apertures 34 to allow interiorly formed, radially-inwardly directed portions 32 to be located at multiple locations. Apertures 34 registerable with portions 32 facilitate the molding of portions 32. The upper extremities 13 of member 16 will be provided with outwardly directed portions cooperating with portions 32 to provide a means of detachably holding member 11 captive to member 16. Means 12 may be optionally provided with means whereby when rotated a sufficient distance a tab rides up on incline (not shown) and snaps behind, by its own resiliency, a stop (not shown) thereby preventing unwanted release. Observe in FIGS. 2, 4 and 5 that apertures 33 are provided in means 12 which communicate with elongated slots 14 in member 11. Apertures 33 are registerable with portions 32 such that upon engaging means 12 with member 16 a locking cable (not shown) may be inserted through apertures 33 thereby causing means 12 to be held captive against further rotation until said cable is removed. A locking cable (not shown) used in conjunction with a combination lock (not shown) may be utilized to lock the device 36 of FIG. 1 which may also be simultaneously locked to any stationary object such as fence posts, hand-railing, trees, special purpose holders, vehicle racks, household storage means, other ski equipment packages, and a variety of other means associated with ski related activities, or the like. According to the principles of the present invention therefore, methods and procedures for assembling any combination of equipment such as skis, poles, and boots are provided within the device 36 of FIG. 1. In a single device 37 illustrated in FIG. 2 the means for carrying and/or securing any combination of said equipment uniquely retained in assembled interrelated positions, as shown in FIG. 1, ready for transporting, storage, securing and/or locking, or activities associated with the equipment retained therewith. Furthermore, according to the methods and procedural steps, and more specifically, the device 37 of FIG. 1 may be manipulated to provide all of the above features for skis and poles without boots as illustrated by device 38 of FIG. 3. Still further, from FIGS. 1 and 2 it is seen that boots may be afforded all of the above mentioned features without skis and poles.

Following the engagement of boots A, B, skis D, poles C, or any desired combination thereof, with device 36 the adjustable securing means 12 may be adjusted down upon top surface of column 16 and secured thereto by means of interiorly located retention means 32 as shown in FIG. 5. A locking cable (not shown) may now be passed through apertures 33 communicating with cooperating opening 14 in column 11 as best shown in FIGS. 2, 4 and 5. The cooperative consequence of the above resulting in a device 36 for carrying and/or securing any desired combination of equipment such as boots A, B skis D and poles C.

Device 38 shown in FIG. 3 illustrates device 37 in a fully retracted posture without equipment secured therewith. Device 38 illustrates generally the posture used for storage, shipping, packaging or sales display because of its compact and space efficient size and also for carrying and/or securing skis and poles, or the like.

Operationally the device 36 of FIG. 1 comprises cooperable retention units 15 and 20 with retention unit 20 forming retention chambers for skis D and poles C. Retention units 15 and 20 further cooperating with securing means 12 thereby providing for adjustment to accomodate all boot sizes and positive locking for security. The cooperable equipment engaging parts are further illustrated in FIG. 2 where the lower retention unit 20 has congruous boot retainers 18 symmetrically disposed about central column member 16 with substantially coextensive side portions 19 thereby providing means for inserting the boot soles therewith. When the opposite boot ends are placed under cooperable retainers 5 the boots A and B are thereby retained following which a slight downward pressure on handle 1 simultaneous with manipulation of securing means 12 caused the boots to be secured therewith.

The particular formation of the upper boot retainer unit 15 may be widely varied due to manufacturing techniques and construction materials. As illustrated in FIG. 2 the carrying handle 1 is molded integral with the upper retainer structure 2 and adjustable upper column 11. Cooperating with the upper retainer unit 15 is an oppositely disposed lower retainer unit 20 slidable mounted on lower column 16. The formation of retainer unit 20 includes a pair of ski magazine sidewalls 22 downwardly depending from top surface structure 17 with pole chambers 26 disposed therewith as illustrated in FIGS. 2, 3 and 6.

With regard to the formation of upper retainer unit 15 observe in FIG. 10 that retainers 5 are disposed symmetrically about handle 1 being pivotally mounted for rotation in zones K and L. In another preferred embodiment boot retainers 5, with side portions 4, may be formed integral with handle structure 1 as illustrated by a fixed position K thereby forming cooperable jaws for engaging with boot toes or heels substantially as shown in FIG. 1. Using this particular formation together with downwardly depending members from side flanges 6 or sole rest surface 7 would achieve results corresponding to the function of retainers 5 in FIG. 3. Furthermore, with regard to this alternate embodiment, observe in FIG. 2 that units 15 and 20 would then comprise a pair of oppositely disposed cooperable parts, or jaw type retainers, adapted to receive equipment such as boots A and B for releasable securement therebetween, and having substantially equivalent assembly characteristics as described for illustration 36 in FIG. 1.

Symmetrically disposed relative to the retainer units 15 and 20 is lower mounting column 16 generally formed integral with base flange 24, ski support base 27, and ski retainers 23 and structurally interconnected by base member reinforcing ribs 25. Thus, device 37 of FIG. 2 is comprised of three basic parts 15, 20 and 16, two of which are adjustable relative to part 16 by means of adjustable securing means 12. Therefore, depending upon the context being utilized in this description it is important to note that member 16 in the broader context refers to a base member for device 37 while in the limited sense 16 is a column member portion of base member 16 comprising column member 16, ski support bases 27, ski retainers 23, base ribs 25 and exterior base member flanges 24.

Furthermore, it is instructive to teach that the ski and pole retention means 39, as illustrated best in FIG. 6, may be constructed such that side walls 22 project downwardly generally to a height corresponding with pole retention means 40 and ski retainer side wall 23 may be increased in height to a level corresponding generally with pole retention means 40. These, as well as other minor variations, are considered within the spirit and principles of the device 37 illustrated in FIG. 2.

Observe in FIGS. 2 and 6 that column member 11 upon initial erection may have its lower extremity extended downwardly until it projects slightly below base members 24 thereby allowing an internal stop means (not shown) to be inserted interiorly to project outwardly through apertures (not shown) in side wall of member 11 and into recessed raceways (not shown) in the interior side walls of member 16 such that the member 11 cannot be accidentally completely detached from engagement with member 16.

Securing means 12 is adjustably engaged with a peripheral portion of column 11 by formed engagement means 31 shown in FIG. 5 and cooperative engagement means 30 shown in FIG. 2. Retention means 32 projecting from the interior surface of securing means 12 engage below cooperating projections on the exterior surface 13 of column member 16 whereby partial rotations of means 12 will engage or disengage means 12 from column 16. Means 12 remains operatively engaged with column 16 and may be adjusted up or down column 16 by rotating means 12 relative thereto. Illustrated in FIGS. 2, 4 and 5 are cooperating apertures 14 and 33 through which a locking cable (not shown) may be inserted thereby locking securing means 12 against rotation thus preventing any further adjustment of device 36 shown in FIG. 1. Thus, the three main elementary parts 15, 20 and 16 are each preferably formed as unitary members molded from a suitable plastic each cooperating with the other to provide the important features of construction necessary for compactness, simplicity, ruggedness, lightweight and uniquely adaptable to engage ski equipment A, B, C and D utilizing the method of assembly described herein.

Although the present invention device 37, has been illustrated and described herein for use in carrying and securing ski equipment, it is evident from a broader standpoint, that the purpose of device 37 is to carry and secure equipment of the nature illustrated whether it be ski equipment, hunting equipment, fishing equipment, mountain climbing equipment, industrial safety equipment, some form of special tools, or some form of special apparatus associated with a particular job speciality which may be domestic or military in application. It should be understood, therefore, that it is not intended to limit the principles of the present invention to ski equipment alone, but rather to equipment according to the utilization principles of the present invention for various other uses, all of which are fully contemplated according to the present invention. Tennis and Golf equipment are also considered.

Coming now to the advantages of the present invention and, thus, according to the principles of the device 37, a unique means for carrying and securing ski equipment, or the like, is obtained. First, the capability of carrying and securing skis D, poles C and boots A and B in a single device 36. Secondly, the capability of carrying and securing skis D and poles C without boots A and B in device 38 according to FIG. 3, or with boots A and B according to FIG. 1 with the skis D and poles C removed. Thirdly, virtually foolproof adjustment means due to the simplicity thereof. Fourthly, trouble-free service assured for repeat operations and usage. Fifthly, enhanced safety to both user and others because device 36 allows the equipment to be conveyed with its center of gravity below the users center of gravity thereby creating ultimate stability under conditions otherwise extremely hazardous. Sixthly, equipment may be stored in one single device having attractive, streamline posture profile for convenient placement not otherwise possible. Seventhly, this single device 37 achieves what conventionally cannot be achieved in two separate devices since the commercially available boot tree does not provide securing means nor does the ski carry devices provide for boots to be carried therewith. Moreover, this is achieved by using a device 37 whose geometric size F, J and H is substantially equivalent to the simplest of the only known devices for carrying only skis and poles.

With reference to FIGS. 7, 8 and 9, it is seen that a generally rectangular structural configuration has been illustrated. It is, however, within the scope of this invention to provide a generally circular configuration contoured to follow the general pattern of part 12. Exteriorly configuration requirements could result from shipping or structural strength characteristics for materials of construction. FIG. 1 illustrates a side profile of device 36 having compact and esthetic dimensions E, F, G, H, I and J.

Manufacturing techniques combined with materials selected for construction can influence the cosmetic appearance, weight, economy, strength of the various parts and complete assembly 37. For instance, using plastic molding techniques could result in using a variety of ribs and open spaces merely to achieve strength, use of less materials and more efficient fabrication procedures. The utilization of metal wire forming, sometimes referred to as skeletonizing, provides an attractive manufacturing means. This technique generally requires that the wire be formed to the perimeter contour of device 37 and because of its greater strength than nonmetals, a skeleton structure results rather than a solid type structure. Engineering properties, such as shear strength, yield, tensile strength, poisson's ration, fatigue strength, corrosion resistance, directionality are important considerations which, when considered together with the fabrication tooling techniques can have an influence upon the exterior appearance of device 37 while at the same time retaining the novel characteristics of the invention described hereinbefore. Often the outside configuration and dimensions of a part, such as device 37, are a function of its intended use and the designer has designed freedom either on the inside or the outside. The highly important choice of wall thicknesses has to be made carefully because of the environmental ramifications involved. There are two conflicting considerations governing the initial choice of wall thickness. To obtain the maximum stiffness in a part, the choice will be the greatest wall thickness in combination with the lowest density. This is because the moment of inertia which determines stiffness and modules of elasticity, is a cube function of the thickness. Therefore, having disclosed the synthesis and analysis of construction features, it is understood that the fundamental novel aspects of the invention can be achieved using a variety of substitutions and changes without departing from the spirit of the invention. The broad theory for the equipment carrying, securing and assembling techniques of this improved device have been shown, described and pointed out including the fundamental novel features as applied to a preferred embodiment 37 comprised of oppositely disposed boot retainer means 15 and 20 which are selectively and movably mounted in a mutually aligned relationship relative to a base member 16 such that manipulation of securing means 12 and its consequential releasable engagement with member 16 results in equipment A, B, C and D being assembly in releasable securement therewith.

The operation of the retention units is the same in either embodiment of the invention. As illustrated in FIG. 1, when the boots designated A and B are to be removed, the securing means 12 is manipulated to detach same from base member 16 following which unit 15 may be retracted slightly thereby allowing retention means 5 to be released from boot toes. Boots A and B may now be fully removed from device 36 thereby allowing retention unit 15 to move downward toward retention unit 20. Retention unit 20 may be moved upward thereby allowing skis D and poles C to be removed from device 36. Device 36 may now assume posture as shown in FIG. 3 ready for the next utilization.

Also, it is significant to observe in FIG. 2 that device 37 may be constructed to carry and/or secure boots A and B without including provisions for skis D and poles C. Thus, as best shown in FIG. 6 dimension P would be made significantly shorter since side walls 22 and 23 could be omitted. Furthermore, observe in FIG. 3 that device 38 could be constructed to carry and/or secure skis D and poles C without provisions for boots A and B. Thus, carrying hand grasp 1 may be constructed integral with top surface 17 of retainer unit 20, thereby omitting members 4, 5, 18 and 19. Each of these variations would retain adjustable securing means 12.

The construction of improved device 37 is particularly suitable to portable equipment such as skis, poles and boots since it permits the manufacturer of a standard compact structure having dimensions in the order of $J=4\frac{1}{2}$ inches, $H=16$ inches, and $F=3\frac{1}{2}$ inches and of a geometric configuration whereupon its utilization results in much less space being occupied by the total equipment installed therein. Moreover, device 36 may be adapted to accomodate ice skates, rollerskates and other equipment related to sports such as golf, baseball, football and the like. It follows, therefore, that this new device construction permits the manufacturer of a simpler and less expensive device to achieve more combined functions than has heretofore been known.

Thus, it will be recognized that I have herein described and illustrated a new and improved device for carrying and/or securing any combination of equipment such as skis, poles and boots having special adaptation and utility in conjunction with user activities in a ski resort environment. It will also be appreciated that a convenient adjusting and locking means 12 is provided for ease and simplicity of operation. The locking means 12 is simple, readily engaged and disengaged, and structurally secure.

All in all, the features of my new and improved carrying and/or securing device bring forth an advancement in the art over prior known devices and with the utilization of structural components and configuration as described produces a synergistic utility effect resulting in improved life and ruggedness for a device of the character described. It will also be recognized and appreciated that the utility of the unique yet simple mechanism, particularly the parts thereof, eliminates the need for maintenance repairs and/or replacement of parts since the structural integrity does not depend upon resilient biasing means. Thus, device 37 will continue to function satisfactorily without yieldable means 9. Securing and locking as used in the description hereinbefore refers to the capability of being secured by the owner such that unauthorized removal and/or use will not be permitted. It also means that the equipment is securely held captive with said device.

The selected modifications herein described for the adaption to a device 36 are set forth for the purpose of completing the disclosure. Depending on the manufacturer and technique used, components molded from a variety of plastics, or other materials, have a good balance of properties and are adaptable to many design requirements. Decisions regarding which technique is best suited for the present invention rest primarily upon economicies and reliability of performance.

Therefore, according to the principles of the present invention, a unique and novel equipment carrying and/or securing device is provided whereby an integrated method of assembling equipment functions basically as a unit during transporting, storage or other uses. While it has been shown and described as a plurality of modified arrangements in which the invention may be embodied, it is to be understood that these constructions have been selected for the purpose of illustration and that various changes in size, shape and arrangement of the parts may be made without departing from the spirit of the invention or the scope of the subjoined claims. While I have shown and described constructions in which my invention may be embodied, it is to be understood, therefore, that variations in the construction and arrangement may be made without departing from the spirit and scope of the invention as disclosed in the appended claims, in which it is intended to claim all novelty inherent in the invention as broadly as permissible, in view of prior art. This invention further resides in the construction, combination and arrangement of elements illustrated in the accompanying drawings, and while I have shown thereon preferred embodiments, it is to be understood that the same is susceptible to modifications and changes; and comprehends other details, arrangement of elements, features and construction without departing from the spirit of the invention, and that all matters herein set forth or shown in the accompanying drawings are to be interpreted as illustrative and not in the limiting sense. In view of this disclosure, variations and modifications will doubtlessly be generated by others skilled in the art to obtain all, or part of the benefits of this invention without duplicating the framework shown, and I therefore claim all such variations and modifications insofar as they fall within the reasonable spirit and/or scope of my proposals and claims.

It is the intention, thus, to be limited only as indicated by the scope of the following claims. Accordingly, the scope of the invention should be determined not only by the embodiment illustrated, but by the appended claims and their legal equivalents, and all changes which come within the meaning and range of equivalence of the claims are therefore intended to be embraced therein.

Having thus described my invention, I claim as new and desire to secure by Letters Patent:

1. A device for carrying and/or securing any desired combination of equipment such as skis, poles and boots comprising:

first retention means for releasable engagement with oppositely disposed boot toes;

second retention means for releasable engagement with oppositely disposed boot heels;

means provided with one of said retention means to retain said skis and poles therewith;

base member cooperating with said retention means for supporting and guiding the selective manipulation of said retention means into cooperative engagement with said equipment;

and securing means releasably engageable to said base member and adjustably disposed on one of said retention means.

2. In a device for carrying and/or securing any combination of ski equipment, or the like, such as boots, skis and poles, cooperable retention units, one of said units having symmetrically related boot retaining means oppositely disposed with respect to a central column member to which the said retention unit is slidably engaged and adapted with yieldable biasing means to urge the unit downwardly thereby releasably retaining said skis and poles, another of said retention units having adjustable securing means for movable engagement with said column member to effect retention of said boots between said retention units and to cause said first retention unit to be urged downwardly resulting in a compressive force being transmitted to both said first retention unit and said skis and poles, said adjustable securing means manipulatively communicated with said column member thereby allowing any combination of said equipment to be selectively engaged into releasable securement therewith.

3. An equipment carrying mechanism for selectively securing a first, second, or third class of equipment, or any combination thereof, and including a base means having a hollow central column member supporting first, second and third retention units for respectively receiving first, second and third class of equipment into cooperable engagement therewith, said first retention unit comprising a threaded column telescopically received within said hollow central column member, said base means having an internally threaded manipulatable securing means mounted thereon and cooperating with said threaded column for incremental adjustment thereto, said second retention unit movably mounted on said base means, said third retention unit disposed integrally with said second retention unit and substantially coextensive therewith, the consequential operation of said cooperable retention units together with said securing means all relative to said base means according to a predetermined relationship for assembling said equipment such as skis, poles and boots, or the like, into releasable securement therewith.

4. A device for carrying and/or securing any desired combination of equipment such as skis, poles and boots comprising:

first retention means for releasable engagement with oppositely disposed boot toes;

second retention means for releasable engagement with oppositely disposed boot heels;

means provided with one of said retention means to retain said skis and poles therewith;

base member cooperating with said retention means for supporting and guiding the selective manipulation of said retention means into cooperative engagement with said equipment; and securing means releasable engageable to exterior surface of the upper terminus of said base member and adjustable disposed on one of said retention means.

5. In an equipment carrying and/or securing device comprising movable retaining units having oppositely disposed symmetrically related releasable boot, or the like, engaging means, one of said retaining units structured with oppositely disposed side walls adapted to form ski and pole retention chambers, said retaining units movably guided by a first and second central column members cooperating with an adjustable securing means whereby said retention units may be manipulated one relative to the other for selectively engaging any combination of equipment such as boots, skis and poles into releasable securement therewith, said securing means internally threaded for manipulatable adjustment with exterior threads on first of said column members and releasably engaged with externally disposed engagement means disposed on the exterior surface at upper terminus of second of said column members.

6. A device of the character described comprising a pair of mutually aligned and selectively manipulatable cooperative retention units, one of said retention units provided with means for retaining skis and poles, each of said retention units having releasable boot engaging means, each of said retention units movable mounted with a central column member having an adjustable securing means releasable engaged thereto and adjustably disposed on one of said retention units such that the consequential functioning causes said equipment to be releasable secured with said device, said securing means interiorly threaded for adjustable engagement to said retention unit and releasably attached to the exterior surface at the upper terminus of said column member.

7. A device for the character described comprising a pair of mutually aligned and selectively manipulatable cooperative retaining units each adjustably mounted in a predetermined relationship relative to a column member, one of said units having a pair of oppositely disposed downwardly depending side walls functioning in cooperation with said column member to form equipment chambers, said device disposed at its lower extremity with a base member, said base member cooperating with said column and said side walls to form said equipment chambers, means adjustably engaged with said column member whereby both of said retaining units may be manipulated one relative to the other for selectively engaging any combination of equipment into releasable securement therewith, said adjustable engagement means disposed exteriorly at the upper terminus of said base member.

8. In a device for carrying and/or securing any combination of ski equipment, or the like, such as boots, skis and poles, cooperable retention units, one of said units having symmetrically related boot retaining means oppositely disposed with respect to a central column member to which the said retention unit is slidably engaged and adapted with yieldable biasing means to urge unit downward thereby releasably retaining said skis and poles, another of said retention units having adjustable securing means for movable engagement with said column member to effect retention of said boots between said retention units and to cause said first retention unit to be urged downwardly resulting in a compressive force being transmitted to both said first retention unit and said skis and poles, said adjustable securing means manipulatively communicated between the exterior of said retention unit and the upper terminus of said column member, said column member having exteriorly disposed attachment means thereby allowing any combination of said equipment to be selectively engaged into releasable securement therewith.

9. In a ski equipment carrying and/or securing device, cooperable units, first of said units having a pair of boot retainers oppositely disposed about a centrally located carrying means, second of said units having a pair of congruous boot retainers disposed symmetrically with respect to a pair of ski and pole retention means movably guided on a centrally located column having a pair of ski support bases at its lower extremity, said units selectively adjustable whereby any combination of said boots, skis and poles may be releasable secured therewith, said adjustment comprising the manipulation of a securing means interiorly threaded for adjustable engagement with said carrying means and with releasable attachment means for detachable securement to the upper terminus of said column member.

10. In a method of assembling ski equipment and the like with a device for carrying and, or, securing said equipment, said equipment being of the type comprising any combination of boots, skis and poles; the steps of:

positioning skis parallel within releasable ski support bases;

following said ski positioning said poles may be positioned onto pole retention chambers after which a magazine unit is moved down into releasable retention therewith;

inserting said boots into releasable engagement with oppositely disposed boot retention members located generally above and perpendicular to the longitudinal axis of said poles and skis;

and performing an adjustment operation after one or more of the above steps whereby said equipment is retained in releasable securement with said device, said adjustment comprising the manipulation of a securing means interiorly threaded for adjustable engagement with a carrying means and with releasable attachment means for detachable securement to the upper terminus of a centrally located base column member.

11. An equipment carrying mechanism for selectively securing a first, second or third class of equipment, or any combination thereof, and including base means supporting first, second and third retention units for respectively receiving first, second and third class of equipment into cooperable engagement therewith, said first retention unit adapted for incremental adjustment relative to said base means, said second retention unit movable mounted onto said base means, said third retention units disposed integral with said second retention unit and substantially coextensive therewith, manipulatable securing means communicating between said first retention means and said base means, the consequential operation of said cooperable retention units together with said securing means all relative to said base means according to a predetermined relationship for assembling said equipment such as skis, poles and boots, or the like, into releasable securement therewith, said securing means comprising interior threads adjustably engaged with said first retention unit and detachable securing means for releasable securement to upper terminus of said base means.

* * * * *